United States Patent [19]

Kawaguchi et al.

[11] Patent Number: 4,616,615

[45] Date of Patent: Oct. 14, 1986

[54] METHOD AND SYSTEM FOR CONTROLLING IDLING SPEED FOR A DIESEL ENGINE

[75] Inventors: Hiroyuki Kawaguchi, Yokohama; Hideyuki Saito, Tokyo; Seishi Yasuhara, Yokosuka, all of Japan

[73] Assignee: Nissan Motor Company, Limited, Japan

[21] Appl. No.: 570,260

[22] Filed: Jan. 12, 1984

[30] Foreign Application Priority Data

Jan. 18, 1983 [JP] Japan ..... 58-6385

[51] Int. Cl.[4] ..... F02M 39/00

[52] U.S. Cl. ..... 123/339; 123/357; 123/358; 123/382

[58] Field of Search ..... 123/339, 357, 358, 359, 123/458, 198 D

[56] References Cited

U.S. PATENT DOCUMENTS

| | | | |
|---|---|---|---|
| 3,722,487 | 3/1973 | Ohama | 123/382 |
| 4,175,530 | 11/1979 | Asano | 123/357 |
| 4,243,004 | 1/1981 | Ritter | 123/358 |
| 4,403,582 | 9/1983 | Yasuhara | 123/357 |
| 4,426,978 | 1/1984 | Sasaki | 123/458 |
| 4,428,341 | 1/1984 | Hassler | 123/359 |
| 4,437,444 | 3/1984 | Yasuhara | 123/458 |
| 4,449,504 | 5/1984 | Furuhashi | 123/382 |
| 4,465,044 | 8/1984 | Yasuhara | 123/357 |
| 4,470,763 | 9/1984 | Yasuhara | 123/357 |
| 4,494,507 | 1/1985 | Yasuhara | 123/357 |
| 4,526,145 | 7/1985 | Honma et al. | 123/357 |
| 4,531,490 | 7/1985 | Kishi | 123/339 |
| 4,539,967 | 9/1985 | Nakajima | 123/339 |
| 4,546,744 | 10/1985 | Bonfiglioli | 123/339 |
| 4,553,516 | 11/1985 | Hasegawa | 123/339 |

FOREIGN PATENT DOCUMENTS

| | | | |
|---|---|---|---|
| 2708437 | 8/1978 | Fed. Rep. of Germany | 123/339 |
| 54-30315 | 3/1979 | Japan | 123/357 |
| 55-54639 | 4/1980 | Japan | 123/357 |
| 1556001 | 11/1979 | United Kingdom | 123/339 |

*Primary Examiner*—Carl Stuart Miller

*Attorney, Agent, or Firm*—Lowe, Price, Leblanc, Becker & Shur

[57] ABSTRACT

In a Diesel engine with a Bosch-type fuel pump or the like having a control lever which determines the fuel injection quantity, idling speed is controlled by a movable stopper which abuts the control lever to place a lower limit on fuel injection quantity during idling. A control unit derives a target idling speed value according to engine temperature, electrical load, etc. and controls the pneumatic actuator of the stopper in accordance with the difference between actual engine speed during idling and the target idling speed. When the engine is not idling, the pneumatic actuator may be controlled to act as a dashpot, damping the return of the control lever to its idling position. Electromagnetically controlled valves respond to the control unit by providing atmospheric pressure or negative pressure to the pneumatic actuator. An auxiliary valve is provided for bypassing a defective atmospheric pressure supplying valve.

17 Claims, 7 Drawing Figures

METHOD AND SYSTEM FOR CONTROLLING IDLING SPEED FOR A DIESEL ENGINE

BACKGROUND OF THE INVENTION

FIELD OF THE INVENTION

The present invention relates generally to an idling speed control method and its system for a Diesel engine which prevents excessively low engine idling speed, unstable engine operation, and engine stalling when auxiliary vehicle equipment associated with a load on the engine such as an air conditioner is operated during engine idling and when the engine is started when the engine cooling water temperature is below a predetermined value, i.e., during cold engine start-up.

SUMMARY OF THE INVENTION

It is an object of the present invention to provide method and system for controlling an idling speed for a Diesel engine wherein the system adjusts an angular position of a control member for controlling an amount of fuel supplied to the engine according to the angular position so that an actual idling speed achieves a target idling speed, the target idling speed being determined depending on whether the auxiliary equipment is operated and whether the engine cooling water temperature is below a predetermined value.

It is another object of the present invention to provide the idling speed control method and system for a Diesel engine which prevents excessive increases in the actual engine idling speed caused by continuous increases in rotational angles of the control member so as to continuously increase the quantity of fuel to the engine due to a failure in a component of the system.

It is still another object of the present invention to provide a cost effective idling speed control system for a Diesel engine.

These objects can be achieved by providing a Diesel engine idling speed control system which comprises a pressure-responsive actuator having a stopper which can engage a control member, the angular position of which controls the amount of fuel injected into the Diesel engine, within a movable range of the control member, a negative pressure source which supplies a negative pressure to the actuator, a first normally-closed electromagnetic valve disposed within a negative-pressure passage connecting the negative pressure source and the actuator, a second electromagnetic valve disposed within a passage branching from the negative pressure passage and normally open to expose the negative pressure passage to atmosphere, a first sensor which detects the engine speed, a second sensor which detects an engine load, a detector which detects an additional engine operating condition, and means for selectively opening or closing of the first and second electromagnetic valves such that the engine idling speed approaches a target idling speed according to an idling operating condition when detection signals from the first and second sensors and the detector are received and the second sensor detects the idling state and for controlling the operations of the first and second electromagnetic valves such that the stopper is moved in the direction of the control member in which the amount of injected fuel increases when the engine is operating well outside of the idling range.

BRIEF DESCRIPTION OF THE DRAWINGS

A more complete understanding of the present invention may be obtained from the following description in conjunction with the attached drawings in which like reference numerals designate corresponding elements and in which.

DESCRIPTION OF THE PREFERRED EMBODIMENTS

Reference will hereinafter be made to the drawings in order to facilitate understanding of the present invention.

Figure 1:
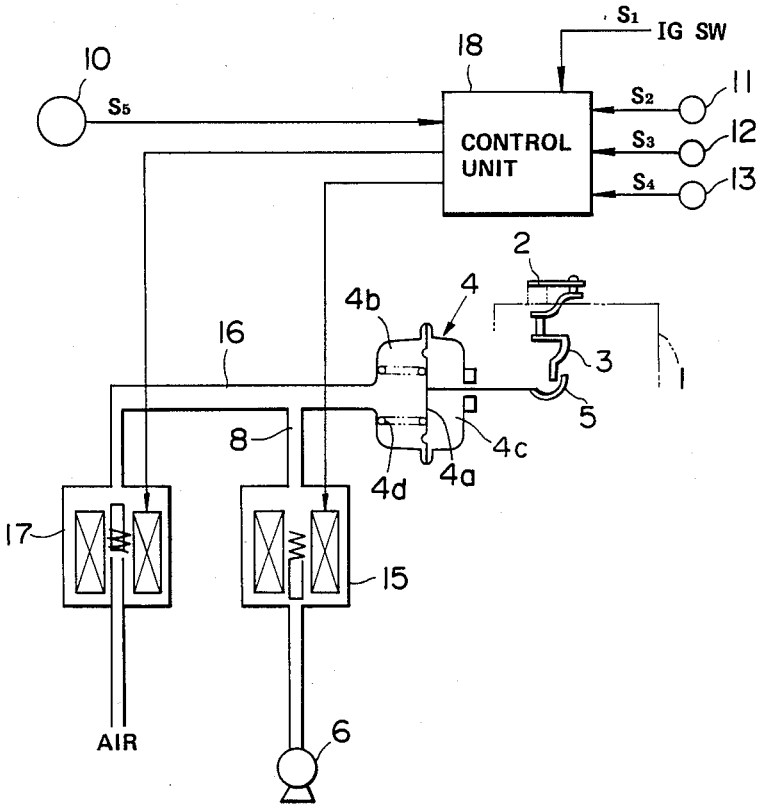
FIG. 1 is a simplified block diagram of a first preferred embodiment according to the present invention wherein portions of the fuel injection pump are omitted.

FIG. 1 shows a first preferred embodiment according to the present invention.

A fuel injection pump 1 is not fully shown in FIG. 1. However, the fuel injection pump 1 and a control lever 2 extending ouside the housing of the pump 1 are detailed in Japanese Patent Publication No. 54-30315 and Japanese Patent Publication No. 55-54639, the disclosures of both of which are hereby incorporated by reference.

As shown in FIG. 1, a pressure-responsive actuator 4 is divided by means of a diaphragm **4*a* into two chambers, a pressure-responsive chamber 4*b* and atmospheric-pressure chamber 4*c*, the pressure-responsive chamber 4*b* having a spring 4*d* seating between a side wall and the diaphragm 4*a* and the atmospheric-pressure chamber 4*c*** being exposed to the air.

The fuel injection pump 1 is provided with the control lever 2 extending therefrom and constituting a control member of the fuel injection pump 1 for controlling the amount of fuel to be injected into the engine. As shown schematically in FIG. 1, a swing arm 3 is pivotably attached to the fuel pump housing 1 and its upper tip is free to abut the free end of control lever 2. The upper tip of arm 3 lies on the low side of the control lever 2, i.e. if the arm 3 and lever 2 are in contact, then if the lever 2 is actuated externally to increase the fuel supply to the engine, the control lever 2 will separate from the tip of swing arm 3.

A stopper 5 having a profile as shown in FIG. 1 extends from the diaphragm **4*a* of the actuator 4 through the atmospheric chamber 4*c* into the range of movement of the lower tip of the above-described swing arm 3. The stopper 5 serves to limit the minimum amount of injected fuel mediated by the control lever 2 when the stopper 5 abuts the swing arm 3. Vacuum pressure generated by a negative-pressure generator 6 is conducted to the pressure-responsive chamber 4*b* of the actuator 4 via a negative-pressure passage 8**.

Also shown in FIG. 1, a negative-pressure control valve 15 disposed within the negative-pressure passage 8 normally closes the negative-pressure passage 8 when not energized and open same when energized by a control unit 18. An atmospheric-pressure inlet passage 16 connected to an air cleaner (not shown) merges with the negative-pressure passage 8, and an atmospheric-pressure inlet valve 17 disposed within the atmospheric-pressure inlet passage 16 is normally held open to expose the negative-pressure passage 8 to the atmosphere.

It should be noted the above-mentioned negative-pressure control valve and atmospheric-pressure inlet valve 15 and 17 are capable of being controlled not to open or close continuously or through a plurality of steps but rather open and close strictly between fully on and off positions selectively on the basis of an electromagnetic switching action.

The control unit 18 comprises a microcomputer having an input/output interface, memory, and a Central Processing Unit (CPU). The individual circuit blocks are not shown. The input/output interface of the control unit 18 receives various signals: an ON/OFF signal $S_1$ sent from an ignition switch IG; an engine speed-indicative signal S2 from an engine speed sensor 11 which detects the current engine speed n, e.g., from crankshaft rotation or ignition timing; an auxiliary equipment operation-indicative signal S3 derived from an accessory equipment switch 12 capable of detecting the operational state of accessories such as an air conditioner or torque converter associated with the engine; an accelerator pedal depression angle-indicative signal S4 from an acceleration sensor 13 which detects a depression angle of an accelerator pedal; and a water temperature-indicative signal S5 from a cooling water temperature sensor 10 which detects the cooling water temperature of the engine.

The load on the engine is detected by the acceleration sensor 13, or alternatively is detected from the rotational angle of the control lever 2 or the displacement of a control member except the control lever 2 which controls the amount of fuel injected by the fuel injection pump 1.

It should be noted that the acceleration sensor 13 detects the idling state on the basis of the depression angle of the accelerator pedal (not shown). The control unit 18 determines that the engine is idling depending on whether the depression angle of the accelerator pedal detected by the acceleration sensor 13 coincides with a predetermined angle assumed by the accelerator pedal during idling.

A target idling speed $n_e$ previously set on the basis of the water temperature-indicative signal S5 from the cooling water temperature sensor 10 and the accessory equipment operation-indicative signal S3 from the accessory equipment switch 12, which is stored in the memory of the control unit 18.

When the engine is detected to be operating in the idling state on the basis of the signal $S_4$ from the acceleration sensor 13, the control unit 18 compares the actual idling speed n obtained from the engine speed-indicative signal S2 from the sensor 11 with the target idling speed $n_e$ fetched from the memory thereof, and selectively controls the negative-pressure control valve 15 and the atmospheric-pressure inlet valve 17 so as to adjust the actual idling speed n to match the target idling speed $n_e$ if they do not agree with each other.

On the other hand, when the engine is detected to be changing from the idling state to a normal running state, the control unit 18 does not actuate the pressure control valve 15 and atmospheric-pressure inlet valve 17 (i.e., the pressure control valve 15 is closed and atmospheric-pressure inlet valve 17 is open) for a predetermined period of time $t_1$ so that the negative-pressure passage 8 is exposed to atmosphere to displace the stopper 5 rightward as viewed in FIG. 1 (Under this condition, the control lever 2 will mediate the minimal limit value of fuel injection quantity if the swing arm 3 is forced by the control lever 2 to abut the stopper 5). The predetermined period of time $t_1$ is determined to allow for the time required for the controlled negative pressure within the negative-pressure passage 8 to settle to atmospheric pressure.

Thereafter, the control unit 18 actuates both valves 15 and 17, i.e., the atmospheric pressure inlet valve 17 is closed and the negative-pressure control valve 15 is opened for a predetermined period of time td so as to introduce the negative pressure into the negative-pressure passage 8 and the pressure-responsive chamber **4*b*, thereby moving the stopper 5 slightly leftward as viewed in FIG. 1. (Under this condition, the stopper 5 is shifted to a position at which the control lever 2 will mediate a fuel injection quantity corresponding to an idling speed higher than the target idling speed $n_e$ if the swing arm 3 is forced by the control lever 2 to abut the stopper 5**). The predetermined period of time td is previously set according to one of the accelerator depression angle, the idling speed, or the cooling water temperature at the instantaneous time when the engine operating condition changes from the idling state to another running state.

Figure 2:
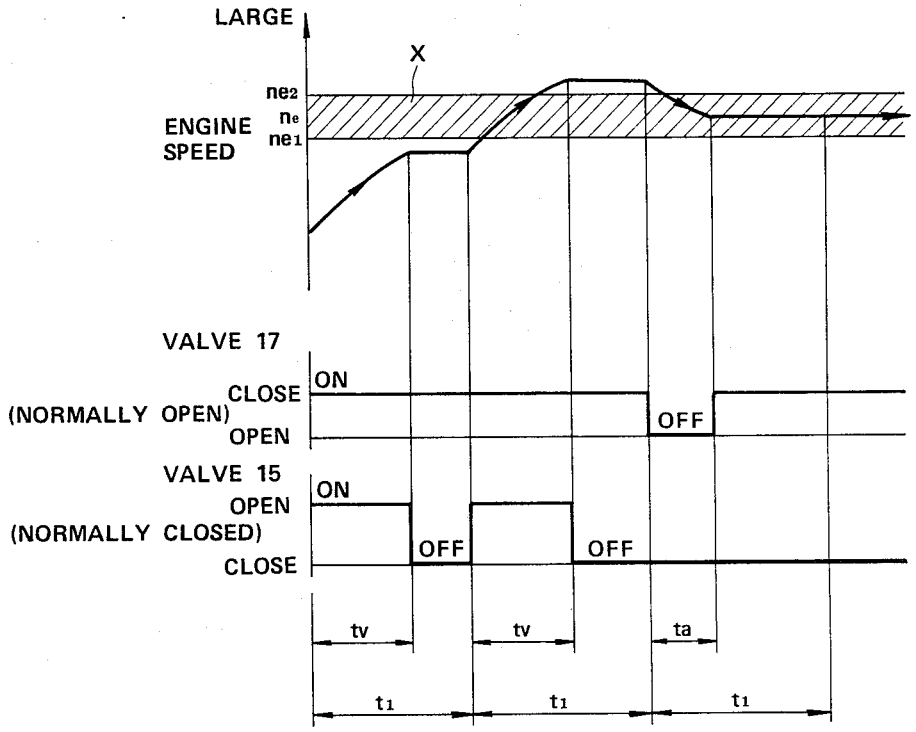
FIG. 2 is a timing chart of an operating control parameter in the case of an engine operating in the idling state to which the first preferred embodiment shown in FIG. 1 is applied.

The operation of the idling control system of the first preferred embodiment during idling will be described in detail with reference to the timing chart of FIG. 2 and the flowchart of FIG. 3.

The control unit 18 derives the actual idling speed n from the engine speed signal S2 received from the engine speed sensor 11 whenever a predetermined period of time $t_1$ has passed and compares the actual idling speed n with the target idling speed $n_e$ previously set on the basis of the accessory equipment operation signal S3 from the auxiliary switch 12 and the water temperature signal S5 from the water temperature sensor 10. Since the target idling speed $n_e$ actually represents an engine speed band X having a predetermined width $2\alpha$ (the region indicated by oblique lines between the lines $ne_1$ and $ne_2$ in FIG. 2 and a represents $|ne-ne_2|$ and $|ne-ne_1|$), the control unit 18 at each time of $t_1$ determines whether the actual idling speed n is within the engine idling speed band X by solving the following inequality: $|n-n_e| \leqq X/2$ as seen in FIG. 3.

Figure 3:
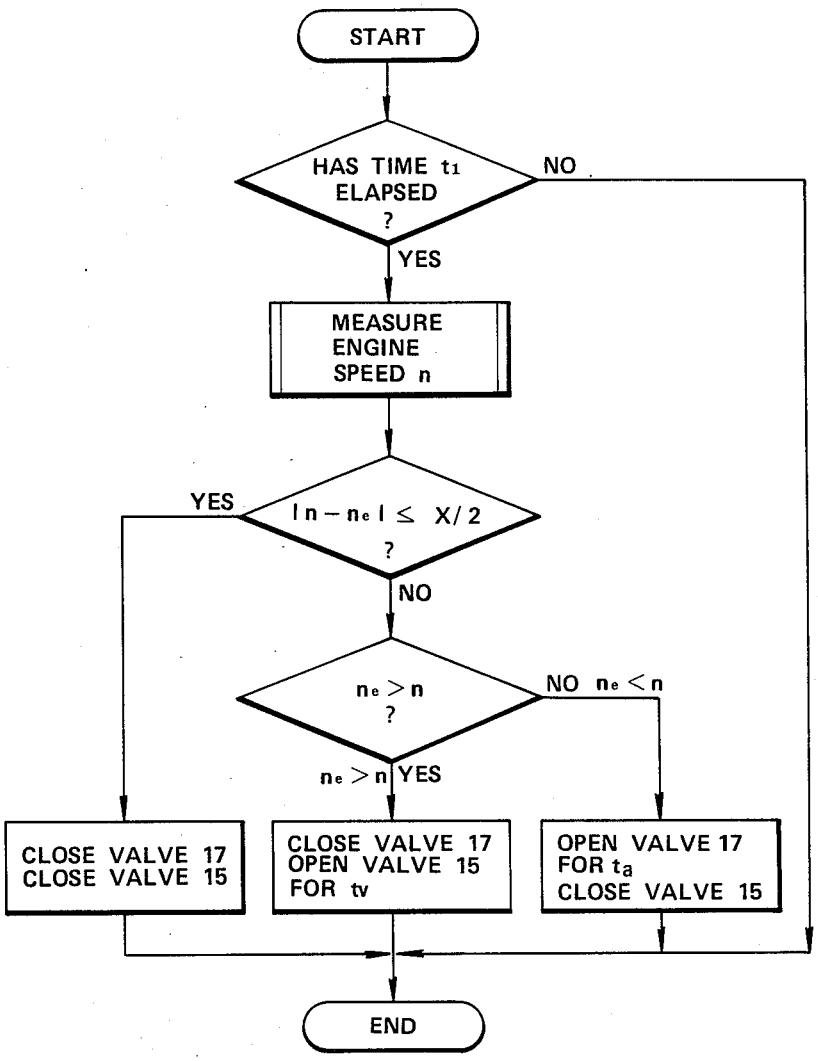
FIG. 3 is an operational flowchart of a control unit in the first preferred embodiment when the engine is operating in the idling state.

In the case where the actually measured idling speed n is lower than the target idling speed $n_e$ i.e., the answer of $|n-n_e| \leqq X/2$ is NO and subsequent answer of inequality $ne>n$ is YES as shown in FIG. 3, the control unit 18 actuates the atmospheric-pressure inlet valve 17 to close while actuating the negative-pressure control valve 15 to open for a predetermined period of time tv to intensify the controlled negative pressure in the actuator 4, i.e., in the pressure-responsive chamber **4*b* and thus to shift the stopper 5 and the swing arm 3 such that the control lever 2 is pivoted via the swing arm 3** to increase the amount of injected fuel to the engine. Consequently, the idling speed n is increased toward the target idling speed $n_e$.

In the case when the actual idling speed n is higher than the target idling speed $n_e$ i.e., the answer of $|n-n_e| \leqq X/2$ is NO and subsequent answer of inequality $ne>n$ is NO, the control unit 18 de-activates, i.e. closes the negative pressure control valve 15 while deactivating, i.e. opening the atmospheric-pressure inlet valve 17 for a predetermined period of time ta, thus reducing the controlled negative pressure within the pressure-responsive chamber 4b by admixture of atmospheric pressure. The stopper 5 is thus shifted in the opposite direction in which the amount of injected fuel to the engine is decreased. Consequently, the idling speed n is decreased toward the target idling speed $n_e$.

When the actual idling speed n is detected to be within the target idling speed band X i.e., the answer of $|n-n_e| \leqq X/2$ is YES, the position of the stopper 5 need not be adjusted, so both the negative-pressure control valve 15 and the atmospheric-pressure inlet valve 17 remain closed, i.e., only the atmospheric-pressure inlet valve 17 is actuated by the control unit 18.

In more detail, the predetermined period of time tv for which the control unit 18 closes the atmospheric-pressure inlet valve 17 while opening the negative pressure control valve 15 in order to increase the idling speed n, and the time ta for which the control unit 18 closes the negative-pressure control valve 15 while opening the atmospheric pressure inlet valve 17 in order to decrease the idling speed n, are necessary to allow the controlled negative pressure applied to the actuator 4 to settle to a stable level. The actual idling speed n may fluctuate until the times tv, ta have passed.

Therefore, if the operation of the negative-pressure control valve 15 and atmospheric-pressure inlet valve 17 take all of the predetermined period of time $t_1$, the idling speed n measured immediately after the end of these operations would only reflect transient phenomena. Thus, stable control would not be achieved if the idling speed n measured during the transient time were compared with the target idling speed $n_e$.

The time tv, ta are, therefore, set so as to satisfy the respective inequalities $tv<t_1$ and $ta<t_1$. The controlled negative pressure (in other words, the actually measured idling speed n) can easily settle within the remaining times ti-tv, ti-ta after the end of operation of the negative-pressure control valve 15 and atmospheric-pressure inlet valve 17 by the control unit 18. In this way, the actual idling speed n measured after each prdetermined period of time $t_1$ will be stable when compared with the target idling speed $n_e$.

Next, the case in which the engine changes to the idling state after engine deceleration will be described below with reference to the timing chart of FIG. 4 and the flowchart of FIG. 5.

Figure 4:
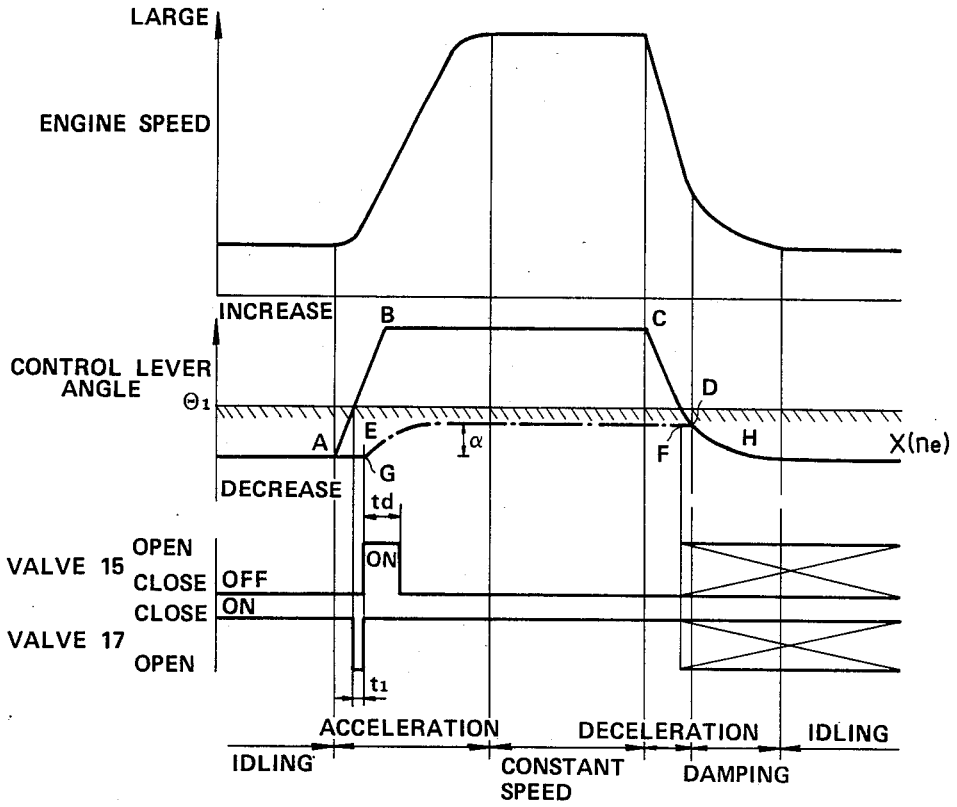
FIG. 4 is a timing chart of a control parameter of engine operation when the engine is operating in a state other than the idling state.

FIG. 4 illustrates the progress of selected parameters as a driver depresses the accelerator pedal from point A until point B to accelerate the engine, holds the engine at a constant speed until point C with the depression force of he accelerator pedal remaining unchanged, and finally releases the depression force from the accelerator pedal to decelerate the engine, thus allowing the engine to return to the idling state.

Depression forces, i.e., angular position changes of the accelerator pedal are directly transmitted to the control lever 2 via a link mechanism (not shown) during the period between points A and B. Since the control lever 2 is pivotted by the accelerator pedal in the direction in which the fuel quantity increases according to the increase in the depression angle of the accelerator pedal, the engine speed increases with high responsiveness. In this case, the control lever 2 separates from the swing arm 3 while the lower tip of the latter remains in contact with the stopper 5. The idling control passes to a halt routine until after point C is reached.

Figure 5:
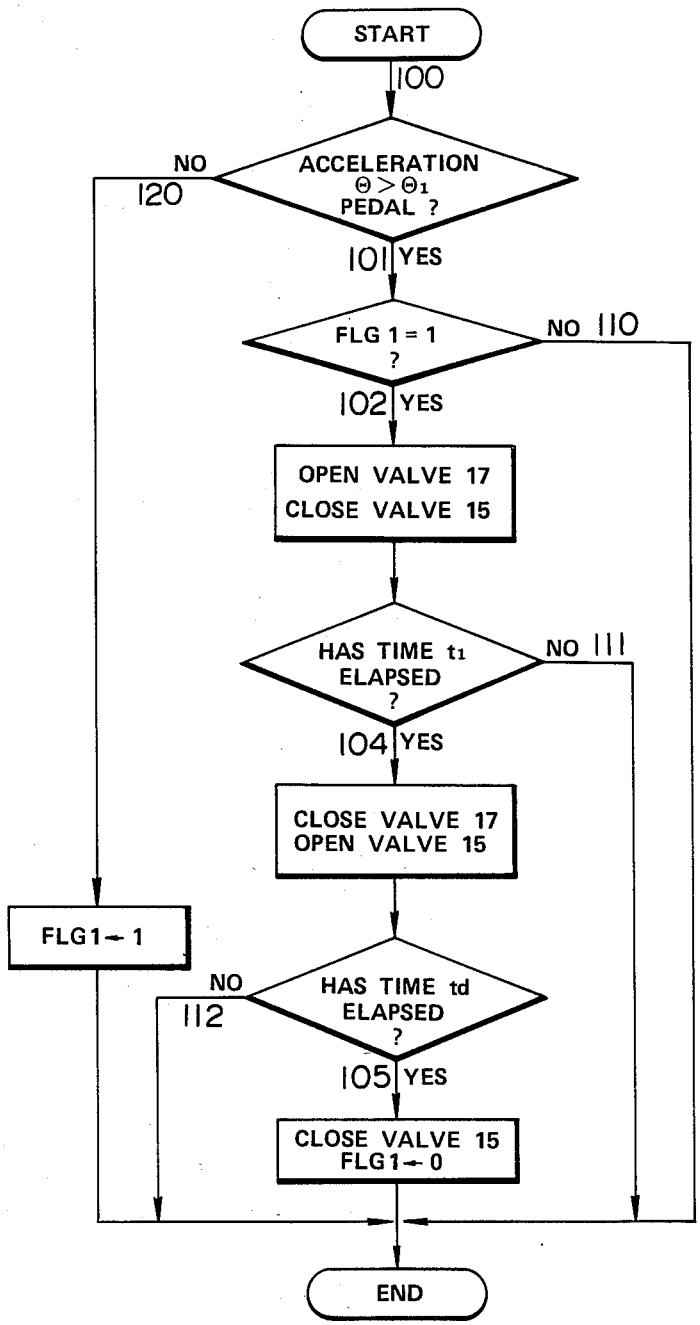
FIG. 5 is an operational flowchart of the control unit in the first preferred embodiment when the engine is operating in a state other than the idling state.

FIG. 5 is an operational flowchart of the control unit 18 during the halt routine.

If the accelerator pedal is depressed through less than a predetermined angular limit $\theta_1$ at an initial program step, a flag FLG 1 is set to "1", allowing the previously described idling control program to be executed. Otherwise, FLG 1 is checked at the next step, and since FLG 1 will be "1" when this routine is first executed, control will pass to a path 102 rather than a null path 110. In the path 102, first the two valves 15 and 17 are once de-energized, i.e., the negative-pressure control valve 15 is closed and atmospheric-pressure inlet valve 17 is opened for the predetermined period of time $t_1$. Thus the negative-pressure passage 8 is exposed to atmosphere, until its pressure reaches a stable value at atmospheric pressure.

After the predetermined period of time $t_1$ has elapsed, the atmospheric-pressure inlet valve 17 is closed and negative pressure control valve 15 is opened for a predetermined time td. Negative pressure is thus introduced into the negative-pressure passage 8. The predetermined period of time td for which the negative-pressure control valve 15 is open is previously set according to one of the accelerator pedal depression angle $\theta$, the idling speed n, or the cooling water temperature at the time when the engine is out of idling. The stopper 5 is moved slightly left as viewed in FIG. 1 during the predetermined period of time td. Due to the characteristics of the pressure-responsive actuator 4, the stopper 5 moves as shown by a curve E in FIG. 4 with a response delay from point G at which the introduction of the negative pressure into the negative-pressure passage 8 begins. The stopper 5 stops moving at a position at which the rotational angle of the control lever 2 would be increased by $\alpha$ in the idling state. (The position of the stopper 5 is shown by a dash-and-dot line of FIG. 4). When a predetermined period of time td has passed, the negative pressure control valve 15 is closed and flag 1 is reset to "0". When this routine is repeated thereafter, control passes through the paths 100, 101 and 110, so that the above-described state remains unchanged.

Next, when the depression force of the accelerator pedal is released at point C, the signal S4 from the acceleration sensor 13 is used to determine that the engine is changing to the idling state. At this time, the negative-pressure valve 15 and atmospheric-pressure valve 17 are selectively opened or closed so that the engine speed n reaches the target idling speed $n_e$ appropriate for the idling state as described above. However, as described above, due to the response delay of the pressure-responsive actuator 4 from the time when the control unit 18 recognizes that the depression force of the accelerator pedal is released, the response of the stopper 5 to the actuator 4 takes time later than the response of the swing arm 3 contacted with the control lever 2 to the release of the accelerator pedal. Due to the net response delay (F-D), the swing arm 3 abuts the stopper 5 at point D before the stopper 5 reaches the target idling speed. Thereafter, due to the balance between the response delay of the actuator 4 and stopper 5 and the biasing force of a spring linked to the rotational axle of the control lever 2 (not shown) acting on the accelerator pedal and control lever 2, the displacement speed of the control lever 2 is damped so that the control lever 2 moves towards its target idling speed position at a slow, decelerating rate without hunting as indicated by the curve H in FIG. 4.

That is to say, in the case where the engine changes from a decelerating state to an idling state and the control unit 18 begins to control the idling speed, the initial negative-pressure value of the pressure responsive chamber 4*b*, in other words, the initial value of the idling speed, depends on the predetermined period of time td described before. If the predetermined period of time td is set longer, the controlled negative pressure of the actuator 4 is increased, so that the initial value of the idling speed will be higher. If the predetermined period of time td is set shorter, the initial value of the idling speed will be lowered.

Therefore, the idling speed control system according to the present invention introduces a negative pressure only for the predetermined period of time td.

In addition, if the wiring to either of the negative-pressure control valve 15 or the atmospheric-pressure inlet valve 17 should break, the negative pressure passage 8 will be opened to the air with the negative-pressure control valve 15 closed and atmospheric pressure inlet valve 17 open. Consequently, the stopper 5 would return to the position at which the control lever 2 mediates the minimum limit value of the fuel injection quantity. Therefore, even if the driver releases the accelerator pedal, the stopper 5 will limit the movement of the swing arm 3. Consequently, the stopper 5 will not return to the idling speed increase position, so the engine speed will not continue to increase.

It should be noted that electromagnetic control valves employed in the present invention are less expensive and have better responsiveness than those which can open and close continuously.

Figure 6:
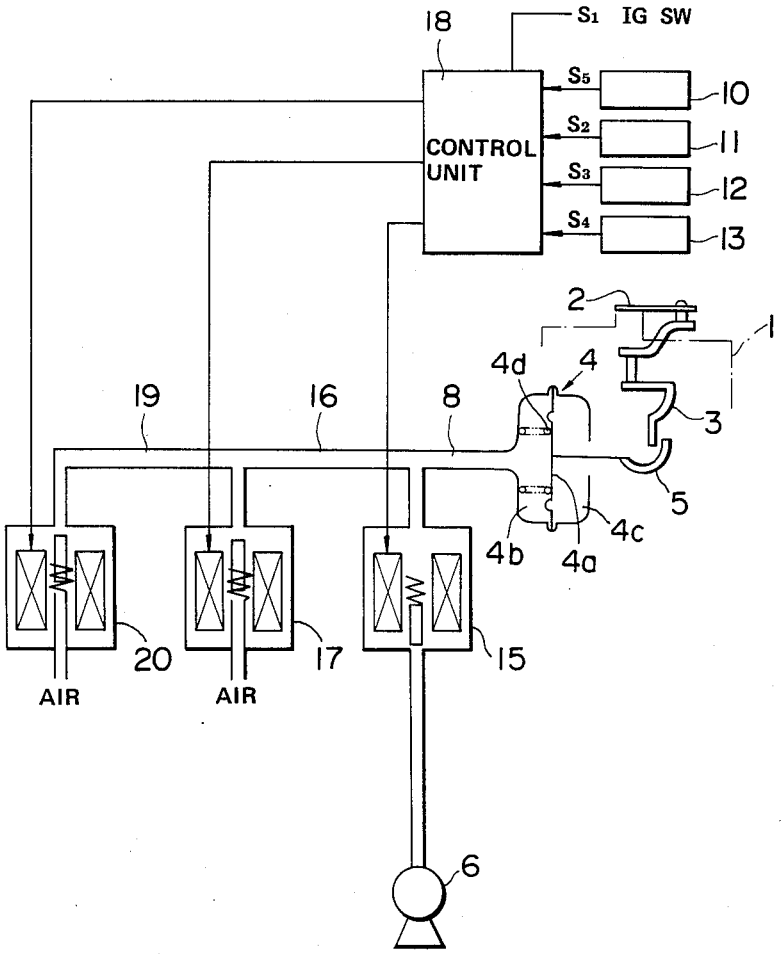
FIG. 6 is a simplified block diaphragm of a second preferred embodiment according to the present invention, portions of the fuel injection pump being omitted.

FIG. 6 is a simplified block diagram of a second preferred embodiment according to the present invention.

As shown in FIG. 6, an auxiliary atmospheric-pressure inlet passage 19 is additionally provided between the atmospheric-pressure inlet passage 16 and the air cleaner, and an auxiliary valve 20 is disposed within the auxiliary atmospheric-pressure inlet passage 19.

It should be noted that all three of the negative-pressure control valve 15, the atmospheric-pressure inlet valve 17, and the auxiliary valve 20 are electromagnetic valves which open or close only between fully-open and fully-closed positions on the basis of the electromagnetic switching action.

Since the control unit 18 comprises the same elements as in the first preferred embodiment, detailed description thereof will be omitted.

In a case where the idling speed n is lower than the target idling speed $n_e$ after a predetermined period of time $t_2$ has passed, the control unit 18 recognizes that the wiring to the normally open atmospheric-pressure inlet valve 17 is broken, stops electrical power supply to the atmospheric-pressure inlet valve 17, and opens or closes the normally-closed auxiliary valve 20 in place of the atmospheric-pressure inlet valve 17 the negative pressure control valve 15 so that the idling speed n reaches the target idling speed $n_e$.

Thus, if the actually measured idling speed converges asymptotically toward the target idling speed during the predetermined period of time $t_2$, more detailed description will be omitted since the operation is the same as in the first preferred embodiment.

In a case where the actually measured idling speed is higher than the target idling speed $n_e$ during the predetermined period of time $t_2$ and does not converge toward the target idling speed, the control unit 18 recognizes that a passage around the atmospheric-pressure inlet valve 17 linked with the atmospheric-pressure inlet passage 16 is clogged, stops the electrical power supply to the atmospheric-pressure inlet valve 17, and sends electrical power to the auxiliary valve 20 to open the auxiliary valve 20 (while the negative-pressure control valve remains closed), thus reducing the negative pressure in the negative-pressure passage in order to decrease the idling speed.

Therefore, in cases where the atmospheric-pressure inlet valve 17 is not capable of opening, the control unit 18 activates the auxiliary valve 20 to open after the predetermined period of time $t_2$ has passed and thus the stopper 5 returns to the position corresponding to the lowest limit value that the control lever 2 provides.

Consequently, the control lever 2 is limited by the stopper 5 via the swing arm 3 even after the driver releases the accelerator pedal so that the danger of the stopper failing to return to the idling speed position due to the continuous supply of vacuum pressure to the pressure-responsive chamber 4*b* via the negative-pressure passage 8, thus allowing the engine speed to continue to increase, can be avoided.

Furthermore, after the predetermined period of time $t_2$ has passed, the auxiliary valve 20 starts to act as the atmospheric-pressure inlet valve 17 and operates in conjunction with the negative pressure control valve 15 to match the idling speed to the target idling speed.

Figure 7:
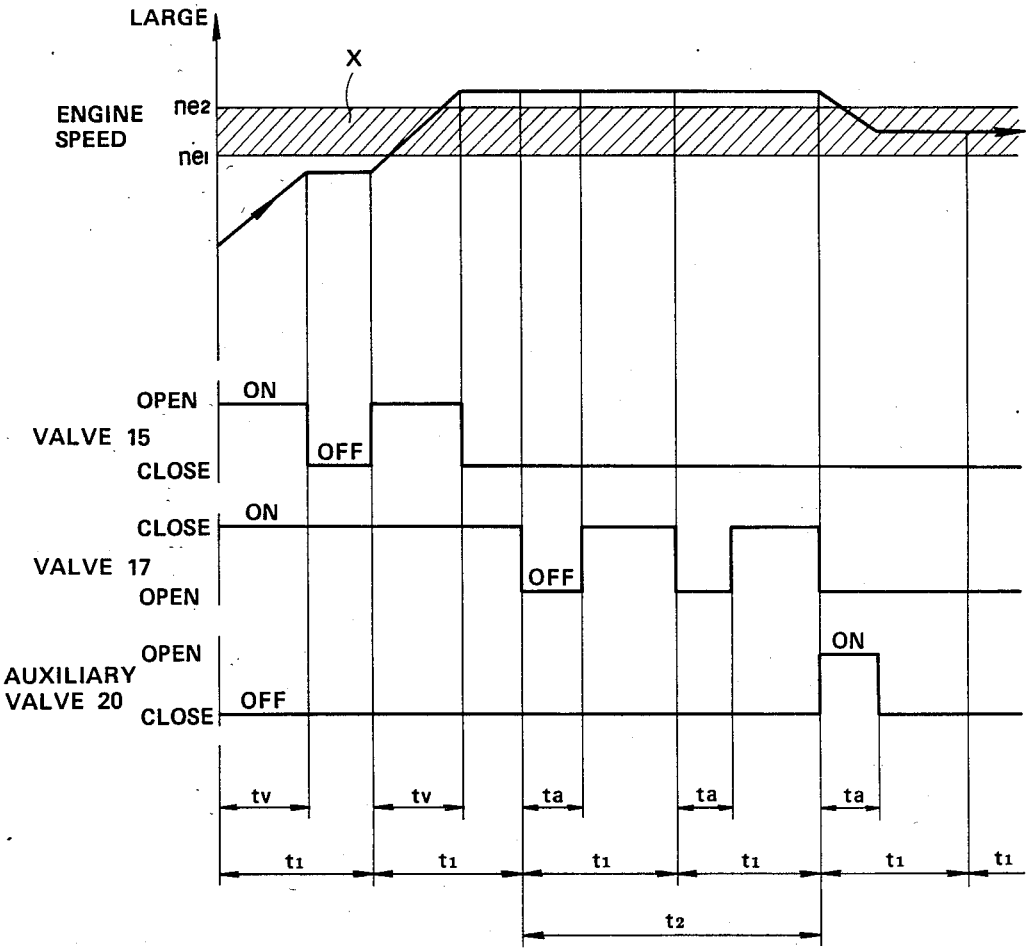
FIG. 7 is a timing chart of a control parameter of engine operation for the second preferred embodiment of the present invention.

In summary, the auxiliary valve 20 is actuated in place of the atmospheric-pressure inlet valve 17 after the predetermined period of time $t_2$ has elasped when the actually measured idling speed is higher or lower than the target idling speed and does not converge toward the target idling speed, with the atmospheric-pressure inlet valve 17 held closed due to its failure. Eventually, the actual idling speed settles to within the idling speed band X as shown in FIG. 7. It should be noted that the auxiliary valve 20 has the same flow cross-section as the atmospheric-pressure inlet valve 17 and the opening period of the auxiliary valve 20 is set to be the same as that (ta) of the atmospheric-pressure inlet valve 17.

In the second preferred embodiment, the idling speed control system comprises an auxiliary atmospheric-pressure inlet passage 19 branching from the negative-pressure passage 8, an auxiliary valve 20 disposed within the auxiliary atmospheric-pressure inlet passage 19 which is normally closed and opens upon energization, and means for actuating the auxiliary valve to serve as the atmospheric-pressure inlet valve in a case where the idling speed is higher or lower than the target idling speed continuously for longer than a certain period of time. This has the advantageous result of a fail safe function preventing excessive increase of the idling speed in case of clogging in the atmospheric-pressure inlet valve 17.

In the above-described first and second preferred embodiments, when the engine changes from idling to normal running, the stopper 5 is eventually moved left as viewed from FIG. 3 or FIG. 6 to increase the idling engine speed when the negative pressure control valve 15 is opened for a predetermined period of time. Consequently, the actuator 4 has a dashpot effect.

In addition, if the duration tv for which the negative pressure control valve 15 is opened in response to an energizing signal from the control unit 14 is the same as that (ta) for which the atmospheric-pressure inlet valve 17 is opened in response to a deenergizing signal from the control unit 14, the range of increase in the engine speed caused by the negative-pressure control valve 15 in response to the energizing signal coincides with the range of decrease in the engine speed caused by the atmospheric-pressure inlet valve 17 in response to the deenergizing signal, thereby resulting in hunting across the target idling speed. Therefore, the control system is more efficient if the durations for which each of the negative-pressure control valve 15 and the atmospheric-pressure inlet valve 17 is opened in response to the signal from the control unit 14 (ta and tv shown in FIG. 4) are not the same and are not related by a simple integral ratio such as 2:1, 3:1, or 4:1.

It will be fully understood by those skilled in the art that the foregoing description is in terms of preferred embodiments of the present invention wherein various changes and modifications may be made without departing from the spirit and scope of the present invention, which is to be defined by the appended claims.

What is claimed is:

1. A system for controlling the idling speed of a vehicular Diesel engine, the engine having a member for controlling an amount of fuel supplied to the engine according to the position thereof, comprising:

(a) A stop member, engaged with said control member during engine idling within a positional range said control member displaces, for limiting the amount of fuel supplied to the engine from said control member during engine idling;

(b) means for selectively adjusting a position of said stop member within the positional range of said control member during engine idling such that the engine idling speed approaches a target idling speed determined according to engine operating conditions at the time of idling, (c) said means for selectively adjusting comprising:

(i) a pressure-responsive actuator linked with said stop member which actuates said stop member according to pressure introduced thereinto;

(ii) a normally closed first valve means which operatively opens to introduce a negative pressure into said actuator so that said control member mediates an increased amount of fuel supply to the engine via said stop member;

(iii) a normally open second valve means which opens to introduce the atmospheric pressure into said actuator so that said control member mediates a decreased amount of fuel supply to the engine via said stop member;

(iv) a control means which selectively closes or opens said first and second valve means such that the engine idling speed approaches the target idling speed, the target idling speed being set according to the engine operating conditions, and (d) a normally closed third valve means which is opened or closed by said control means in place of said second valve means when the engine idling speed does not settle to the target idling speed until a predetermined period of time has elapsed.

2. A system for controlling the idling speed of a vehicular engine, which comprises:

(a) an actuator having two chambers partitioned by a diaphragm and a stopper extending from the diaphragm and capable of engaging a control member, an angular position of which controls the amount of fuel injected by a fuel injection pump into the Diesel engine, said stopper moving within an angularly movable range of the control member according to the pressure within one chamber;

(b) a negative pressure source;

(c) a first electromagnetic valve, located within a first passage connecting said one chamber of said actuator to the negative pressure source, which normally closes said first passage;

(d) a second electromagnetic valve, located within a second passage branching from said first passage, which normally opens the second passage to expose said one chamber of said actuator to atmosphere;

(e) a first sensor means for detecting and signalling the actual engine speed;

(f) a second sensor means for detecting and signalling an engine operating condition when the engine is idling;

(g) a third sensor means for detecting and signalling an engine load;

(h) control means which receives signals from said first, second and third sensor means and opens and closes said first and second electromagnetic valves selectively according to the engine operating condition detected by said second sensor means during engine idling as indicated by the signal from said third sensor means so that said stopper moves the engaged control member to control the amount of fuel injected to the engine to make the engine idling speed approach a target idling speed, and (i) a third auxiliary electromagnetic valve normally closing a third passage opening to the atmosphere and branching from said second passage and wherein said control means actuates said third electromagnetic valve in place of said second electromagnetic valve when the engine idling speed remains higher than the target idling speed for a predetermined period of time.

3. A system for controlling an idle engine speed of a Diesel engine, comprising:

(a) a control member, an angular position of which controls an amount of fuel injected from a fuel injection pump to the engine;

(b) a stop member engaging said control member during engine idling within a predetermined angular displacement range of said control member, for regulating the amount of fuel injected to the engine by said control member during engine idling, said stop member assuring a minimum amount of fuel supply to the engine via said control member during engine start-up;

(c) first means for detecting engine idling operating conditions including engine idling speed;

(d) second means for calculating a target engine idling speed on the basis of the engine idling operating conditions and outputting a first electrical signal when the engine idling speed is below the target engine idling speed and outputting a second electrical signal when the engine idling speed exceeds the target engine idling speed; and (e) third means for selectively adjusting a position of said stop member within the predetermined angular range of said control member during engine idling so that the engine idling speed approaches the target idling speed, said third means producing and introducing a vacuum pressure to displace said stop member to a first position, to increase the engine idling speed in response to the first electrical signal from said second means and said third means being so arranged as to introduce atmospheric pressure to displace said stop member to a second position to decrease the engine idling speed when said second electrical signal is output by said second means.

4. A method for controlling an idling speed of a Diesel engine, comprising the steps of:

(a) measuring an engine speed and engine load;

(b) determining whether the engine is idling on the basis of the engine load;

(c) measuring engine operating parameters other than the engine load;

(d) deriving a target engine idling speed on the basis of the measured engine parameters at which the engine will be able to idle smoothly without excessive fuel consumption;

(e) matching the engine speed with the target engine idling speed;

(f) providing first means for displacing a control element having a position which determines an amount of fuel supply to the engine in first and second directions to increase and decrease the fuel supply to the engine, respectively, according to air pressure exerted thereon;

(g) providing at least two electromagnetic valves, one of said electromagnetic valves being normally open to send atmospheric pressure to said first means so that the control element is displaced in the second direction with another of said electromagnetic valves closed, and the other electromagnetic valve being normally closed and being opened to send a vacuum pressure to said first means so that the control element is displaced in the first direction with the one electromagnetic valve closed; and (h) limiting the displacment of the control element at a minimum fuel supply position through the normally open one electromagnetic valve when the engine speed does not match with the target engine idling speed for a predetermined period of time.

5. A system for controlling an idle engine speed of an engine comprising:

(a) a control means for controlling an amount of fuel supplied to the engine in accordance with a position thereof, (b) a stop means engaging said control means during engine idling for determining a minimum amount of fuel to be supplied to the engine during engine idle, (c) pneumatic control means for displacing said stop means in first and second directions respectively to increase and decrease the minimum amount of fuel to be provided to the engine during an idle condition, (d) at least first and second open-close electromagnetic valve means for providing first and second pressures to said pneumatic control means, (e) said first electromagnetic valve means normally open to provide atmospheric pressure to said pneumatic control means so that the stop means is displaced in the second direction with said second electromagnetic valve means closed, and said second electromagnetic valve means being normally closed and being opened to send a vacuum pressure to said pneumatic control means so that said stop means is displaced in the first direction with said first electromagnetic valve means closed, and (f) system control means for controlling open and close times of said first and second electromagnetic valve means in response to predetermined engine conditions thereby to control the minimum amount of fuel provided to the engine during an idle condition, and (g) limiting means for limiting the displacement of said stop means at a minimum fuel supply position through said normally open first electromagnetic valve means when the engine speed does not match with a target engine idling speed for a predetermined period of time.

6. A system as recited in claim 5 further comprising means for compensating for failure of one of said electromagnetic valve means connected to one of said first and second pressures.

7. A system as recited in claim 6, wherein said means for compensating comprises auxiliary electromagnetic valve means, connected to said one of said first and second pressures, for supplying said one pressure to said pneumatic control means when it is determined that said one electromagnetic valve means connected to said pressure is in a failed state.

8. The system according to claim 3, wherein said stop member disengages from said control member and is displaced to at least the first position by said third means when the engine operation is transferred from engine idle to a normal operation.

9. The system according to claim 3, wherein said third means comprises:

(a) a pressure-responsive actuator linked with said stop member which actuates said stop member according to pressure introduced thereinto;

(b) a vacuum pressure source;

(c) a normally closed first electromagnetic valve which opens to introduce vacuum pressure from said vacuum pressure source into said actuator so that said stop member is displaced to the first position when the first signal is received from said second means and which is closed when said second electrical signal is output by said second means;

(d) a normally open second electromagnetic valve which closes to prevent atmospheric pressure from entering into said actuator when the first signal is received from said second means and which is open to introduce atmospheric pressure into said actuator when said second electrical signal is output by said second means.

10. The system according to claim 9, which further comprises: a third electromagnetic valve which is closed when said second electrical signal is output by said second means and which is open to introduce atmospheric pressure into said actuator in place of said second electromagnetic valve when a third signal for introducing atmospheric pressure into said actuator is received from said second means, the third signal being produced so as to decrease the engine idling speed when the idling speed exceeds the target engine idling speed and when a predetermined time has passed and said second electromagnetic valve remains closed.

11. The system according to claim 9, wherein said second means outputs the first signal only to said second electromagnetic valve to close the second valve when the idling speed matches with the target idling speed.

12. The system according to claim 9, wherein said second means sets first period of time for which said first electromagnetic valve is open and said second valve is closed according to a settling time for which the pressure in said actuator settles at the vacuum pressure from said vacuum source.

13. The system according to claim 12, wherein said second means sets a second period of time for which said second electromagnetic valve is open and said first valve is closed according to a settling time for which the pressure in said actuator settles at atmospheric pressure.

14. The system according to claim 13, wherein said second means sets the first period of time not to coincide with the second period of time and further sets said first and second periods of times to have no integral multiplicative relationship with each other.

15. The method of claim 4 comprising further steps of opening and closing an auxiliary valve means to connect and disconnect an auxiliary passageway to said first means when it is determined that one of said electromagnetic valves is inoperable.

16. A system as recited in claim 9, wherein said first and second electromagnetic valves are each operable only in opened and closed conditions.

17. A system as recited in claim 9, wherein said second means is operable for controlling a minimum idle position of said stop member by varying time durations in which said first and second electromagnetic valves are opened and closed.

* * * * *